US007999836B2

(12) United States Patent
Bandholz et al.

(10) Patent No.: US 7,999,836 B2
(45) Date of Patent: Aug. 16, 2011

(54) SYSTEM AND METHOD OF PRINT MEDIA BACK-FEED CONTROL FOR A PRINTER

(75) Inventors: Brent A. Bandholz, Hubertus, WI (US); Peter G. Ross, Germantown, WI (US); John K. Rohde, Brown Deer, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 243 days.

(21) Appl. No.: 12/482,597

(22) Filed: Jun. 11, 2009

(65) Prior Publication Data

US 2009/0309951 A1 Dec. 17, 2009

Related U.S. Application Data

(60) Provisional application No. 61/061,412, filed on Jun. 13, 2008.

(51) Int. Cl.
*B41J 2/32* (2006.01)

(52) U.S. Cl. ..... 347/218

(58) Field of Classification Search ..... 347/218; 400/611, 614, 614.1, 616, 617
See application file for complete search history.

(56) References Cited

U.S. PATENT DOCUMENTS

| | | | |
|---|---|---|---|
| 5,008,710 | A | 4/1991 | Kobayashi et al. |
| 5,041,850 | A | 8/1991 | Kahoyashi et al. |
| 5,061,946 | A | 10/1991 | Helmbold et al. |
| 5,346,322 | A | 9/1994 | Okamori |
| 5,466,079 | A | 11/1995 | Quintana |
| 5,486,063 | A | 1/1996 | Fox et al. |
| 5,560,293 | A | 10/1996 | Boreali et al. |
| 5,613,790 | A | 3/1997 | Miazga |
| 6,183,148 | B1 | 2/2001 | Martinez et al. |
| 6,314,054 | B1 | 11/2001 | Priebsch |
| 6,375,296 | B1 | 4/2002 | McGarry et al. |
| 6,712,536 | B2 | 3/2004 | Miyano |
| 7,038,703 | B2 | 5/2006 | Ehrhardt |
| 2003/0086740 | A1 | 5/2003 | Miyajima |
| 2006/0007293 | A1 | 1/2006 | Park et al. |

FOREIGN PATENT DOCUMENTS

| | | | |
|---|---|---|---|
| EP | 0950531 | A2 | 10/1999 |
| JP | 2004181887 | A | 7/2004 |
| JP | 2005199595 | A | 7/2005 |
| JP | 2006027216 | A | 2/2006 |
| JP | 2006076032 | A | 3/2006 |

OTHER PUBLICATIONS

PCT/US2009/047012 Search Report & Written Opinion.

*Primary Examiner* — Huan Tran
(74) *Attorney, Agent, or Firm* — Quarles & Brady LLP

(57) ABSTRACT

A system and method is disclosed for print media back-feed control for a printer. The invention incorporates use of a downstream sensor to detect at least one of a leading edge of a print media or an indicia correlated to parameters of the print media. The print media can then be back-fed by a controller to accurately position a print line of the print media proximate to a print head of the printer without losing sufficient nip pressure.

20 Claims, 8 Drawing Sheets

SYSTEM AND METHOD OF PRINT MEDIA BACK-FEED CONTROL FOR A PRINTER

CROSS REFERENCES TO RELATED APPLICATIONS

This application claims priority to U.S. provisional application No. 61/061,412 filed Jun. 13, 2008, which is hereby incorporated by reference as if fully set forth herein.

STATEMENT REGARDING FEDERALLY SPONSORED RESEARCH

Not Applicable.

BACKGROUND OF THE INVENTION

The present invention relates to a system and method of print media back-feed control for a printer, and more particularly to a system and method incorporating a downstream sensor for assisting controlled back-feeding of the print media.

In order for a printer to accurately and repeatedly print a defined image (e.g., text, graphics, etc.) on a particular print media (e.g., paper, adhesive label, transparency, etc.) the spatial relationship between the printer and the print media must be sensed, programmed, or otherwise known by the printer. Moreover, the parameters of the print media (generally including the bounds of the print area of the particular print media) must also be available to the printer. In most printing applications, the print media typically defines a leading edge, a top (i.e., generally the first available print area of the print media as the print media travels through the printer during printing), and a print line location (i.e., the location on the print media where the print head is programmed to print at a particular moment in time). As a result, defined spatial relations, both between the print media and the print head, and relative to the bounds of the print media, allow a printer to produce the desired result.

The spatial relation between the printer and the print media is more important in certain printing applications. For example, a thermal transfer printer incorporates print media that is often packaged as a rolled web of individual repeating labels. The print media is unrolled and directed along a path that passes between the print head (i.e., the general structure that imparts the image to the print media) and an adjacent platen roller. The force established between the print head and the platen roller is referred to as the nip pressure. The nip pressure is designed to create sufficient friction between the print media and the platen roller to allow the platen roller to direct the print media downstream or upstream relative to the print head. Proper operation of the printer requires that a portion of the print media remain between the print head and platen roller at all times, thereby ensuring that the nip pressure maintains the platen roller in driving engagement with the print media.

Programming or manually setting the spatial relations and print media parameters for each print media is repetitive and time consuming. As a result, printers often include a sensor positioned between the print media supply spool and the print head to detect at least the start of a label or other print media. Thus, as the print media is directed toward the print head, the sensor senses indices (e.g., notches) of the print media that are correlated to a particular print line location, such as the top of the print media of a preprogrammed print media having known parameters. In effect, the spatial relationship between the print media and the print head of the printer is therefore defined.

The above techniques work well until the spatial relationship between the print media and the print head is degraded or becomes undefined. This may occur when the power to the printer is cycled, when a new web of print media is installed, as the result of a print media jam, or many other circumstances that prevent a printer controller from knowing the present spatial position of the print media relative to the print head.

The spatial relation between the print media and the print head can be reestablished in a variety of ways. For example, the printer can simply feed the print media downstream until the sensor between the print media and the print head senses the top of the print media; however, this approach results in wasted print media. Alternatively, the print media may include complex indices that provide a relatively accurate indication of the present location of the print media; however, this results in expensive print media due to the addition of the detailed indexing and may not provide the needed accuracy for high-quality printing.

An additional approach is to back-feed the print media upstream toward the print head; however, this results in the print media being inadvertently back-fed beyond the print head, resulting in a loss of nip pressure acting on the print media at the interface between the print head and the platen roller. Without the nip pressure, the platen roller is unable to drive the print media requiring user intervention to re-feed the print media between the print head and the platen roller—wasting the user's time and causing frustration.

In light of the above, a need exists for a system and method that provide for efficient, economical, and autonomous print media back-feed control.

SUMMARY OF THE INVENTION

The present invention provides a system and method of print media back-feed control incorporating a sensor downstream of a print roller. The system and method ensure that the spatial relation between the print media and the print head is reestablished during printer power cycles and print media replacement. Moreover, the system and method of the present invention are efficient, economical, and minimize undesired user intervention caused by excessive back-feeding.

In one aspect, the invention provides a method of print media back-feed control for a printer. The method includes the steps of providing a print media having a leading edge and defining a print line location, and providing a printer having a print head for printing to the print media, a drive roller for driving the print media upstream and downstream relative to the print head, and a downstream sensor positioned downstream of the drive roller. The method further includes the steps of detecting the leading edge of the print media with the downstream sensor and back-feeding the print media upstream with the drive roller to position the print line proximate the print head.

In another aspect, the invention provides a method of print media back-feed control for a printer, comprising the steps of providing a print media having a leading edge and including indices correlated to a print line location, and providing a printer having a print head for printing to the print media, a drive roller for driving the print media upstream and downstream relative to the print head, a downstream sensor positioned downstream of the drive roller, and a controller in communication with at least one of the print head, the drive roller, and the downstream sensor. The method further includes the steps of detecting at least one of the leading edge and the indices of the print media with the downstream sensor and back-feeding the print media upstream with the drive roller to position the print line proximate the print head.

In a further aspect, the invention provides a system for print media back-feed control including a print media having a leading edge and indices correlated to a print line location. The system further includes a printer having a path for receiving and directing the print media through the printer, a print head positioned adjacent the path for printing to the print media, a drive roller positioned adjacent the path for driving the print media upstream and downstream relative to the print head, and a downstream sensor positioned adjacent the path and downstream of the drive roller. The downstream sensor detects at least one of the leading edge and the indices of the print media as the print media travels along the path, and the drive roller selectively back-feeds the print media upstream along the path to position the print line proximate the print head.

In yet a further aspect, the invention provides a printer for driving a print media along a path for receiving and directing the print media through the printer. The printer comprises a print head positioned adjacent the path for printing to the print media, a drive roller positioned adjacent the path for driving the print media upstream and downstream relative to the print head, and an upstream sensor positioned proximate the path and upstream of the drive roller. The upstream sensor includes a first upstream sensor portion positioned adjacent the path and a second upstream sensor portion offset from the first upstream sensor portion in a first direction and a second direction substantially relative to the path.

These and still other aspects of the present invention will be apparent from the description that follows. In the detailed description, a preferred example embodiment of the invention will be described with reference to the accompanying drawings. This embodiment does not represent the full scope of the invention; rather, the invention may be employed in other embodiments. Reference should therefore be made to the claims herein for interpreting the breadth of the invention.

DETAILED DESCRIPTION OF THE PREFERRED EXAMPLE EMBODIMENT

The preferred example embodiment of the invention will be described in relation to a thermal transfer printer. However, the present invention is equally applicable to other types and styles of printers that may benefit from the incorporation of a system and method to prevent excess back-feeding of a print media.

Figure 1:
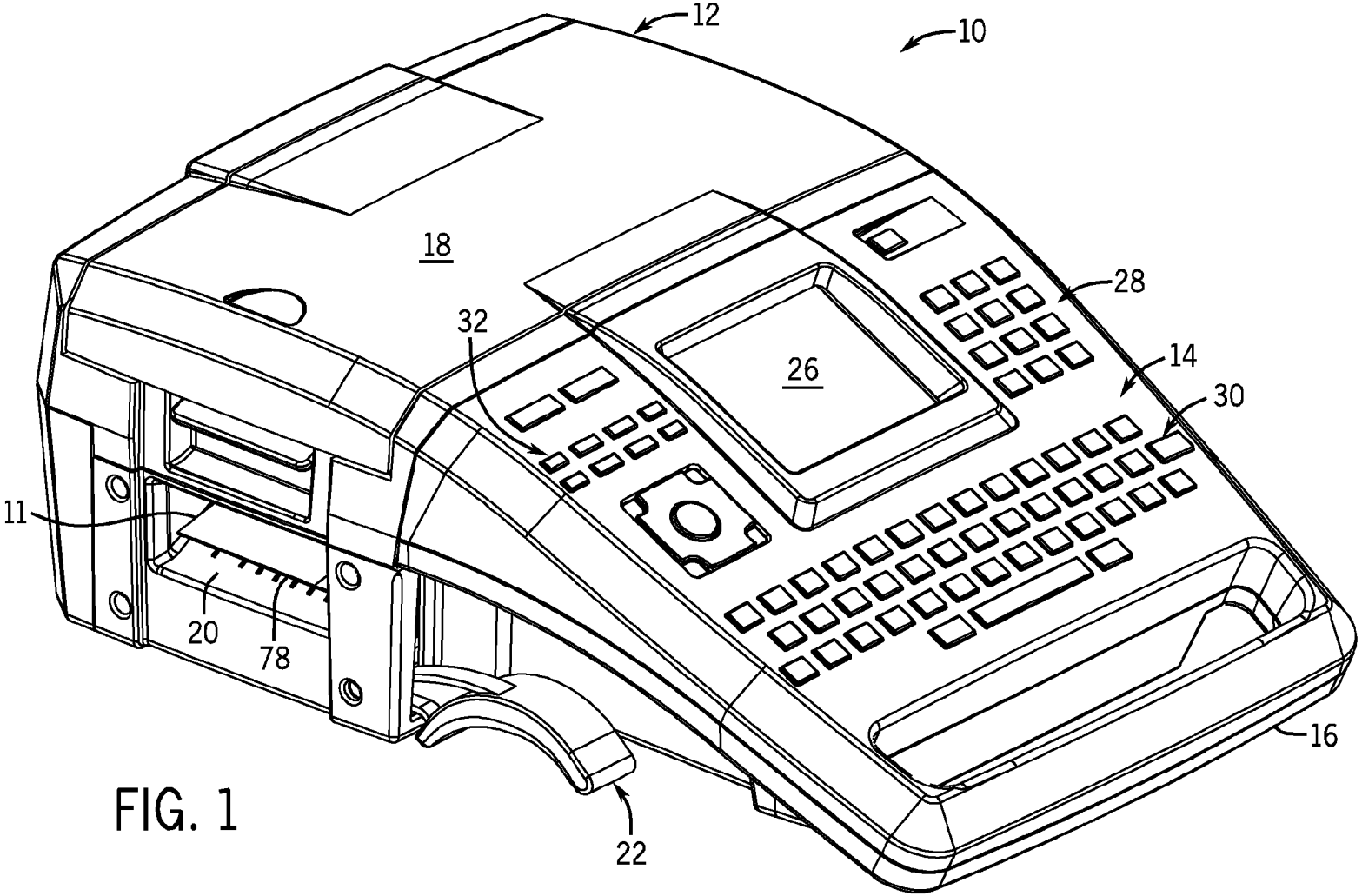
FIG. 1 is an isometric view of a printer incorporating the present invention.

With initial reference to FIG. 1, a printer 10 capable of printing on a print media 11 (e.g., adhesive labels, plain paper, plastic transparencies, and the like) is shown. The printer 10 has a body 12 including a user interface 14 for communication between a user and the printer 10, a handle 16 for easy transport of the printer 10, a moveable cover 18 for accessing a print assembly 34 (best shown in FIGS. 2 and 3) contained within the body 12, a print slot 20 from which the printed-on print media 11 exits from the printer 10, and a cutting assembly 22 for assisting in the cutting or separation of the print media 11.

The user interface 14 may include, but is not limited to, a display 26 for displaying information, a keypad 28 and a keyboard 30 for entering data, and function buttons 32 that may be configured to perform various typical printing functions (e.g., cancel print job, advance print media, and the like) or be programmable for the execution of macros containing preset printing parameters for a particular type of print media 11. The user interface 14 may be supplemented by or replaced by other forms of data entry or printer control such as a separate data entry and control module linked wirelessly or by a data cable operationally coupled to a computer, a router, or the like. Additionally, the user interface 14 is operationally coupled to a controller 15 (shown in FIG. 8) for controlling the operation of the printer 10 (discussed below in greater detail).

Figure 2:
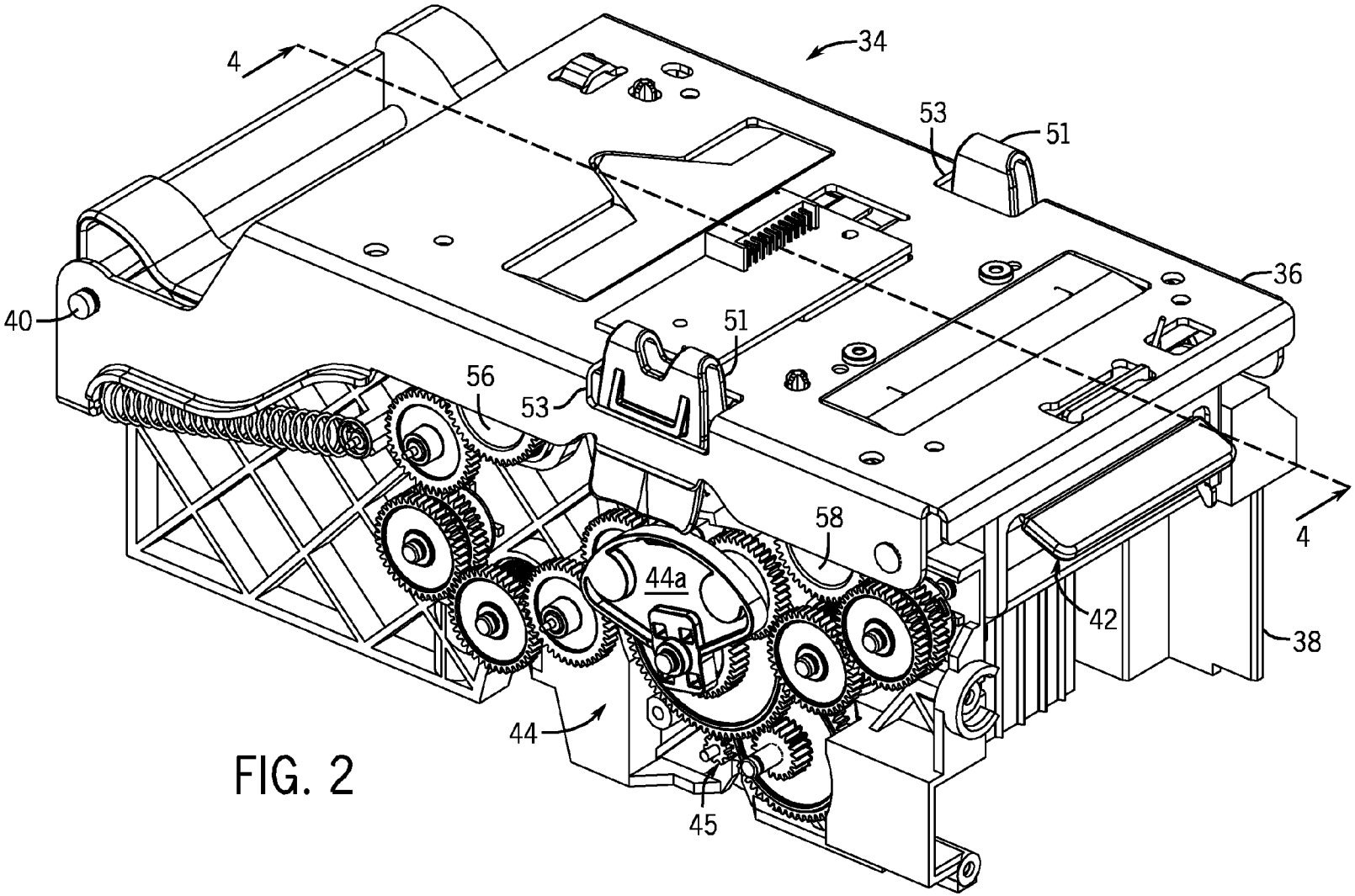
FIG. 2 is an isometric view of a print assembly shown removed from the printer of FIG. 1.

Referring now to FIG. 2, the print assembly 34 is shown after having been removed from the inside of the printer 10. The print assembly 34 includes an upper print frame 36 and a lower print frame 38. On one end, the upper print frame 36 and the lower print frame 38 are pivotally connected at a hinge 40. On the opposite end, a latch 42 releasably secures the upper print frame 36 and the lower print frame 38 together in the closed position. Additionally, a gear train 44 is mounted on the side of the lower print frame 38 for transmitting rotation of a drive motor 45 to a drive roller 47 (shown best in FIG. 4) and a ribbon cartridge 50 (shown best in FIG. 3). In the preferred example embodiment described with reference to a thermal transfer printer 10, the drive roller 47 is preferably a platen roller. The structure and operation of the print assembly 34 and gear train 44 are described in related United States Application No. 61/061,432, filed Jun. 13, 2008, which is hereby incorporated by reference as if fully set forth herein. In general, however, the drive motor 45 drives the drive direction assembly 44*a*. The drive direction assembly 44*a* in turn drives the drive roller 47 and ribbon cartridge 50, through a series of friction and idler gears, in either an upstream direction (as shown) or a downstream direction, depending on the orientation of the drive direction assembly 44*a*.

Figure 3:
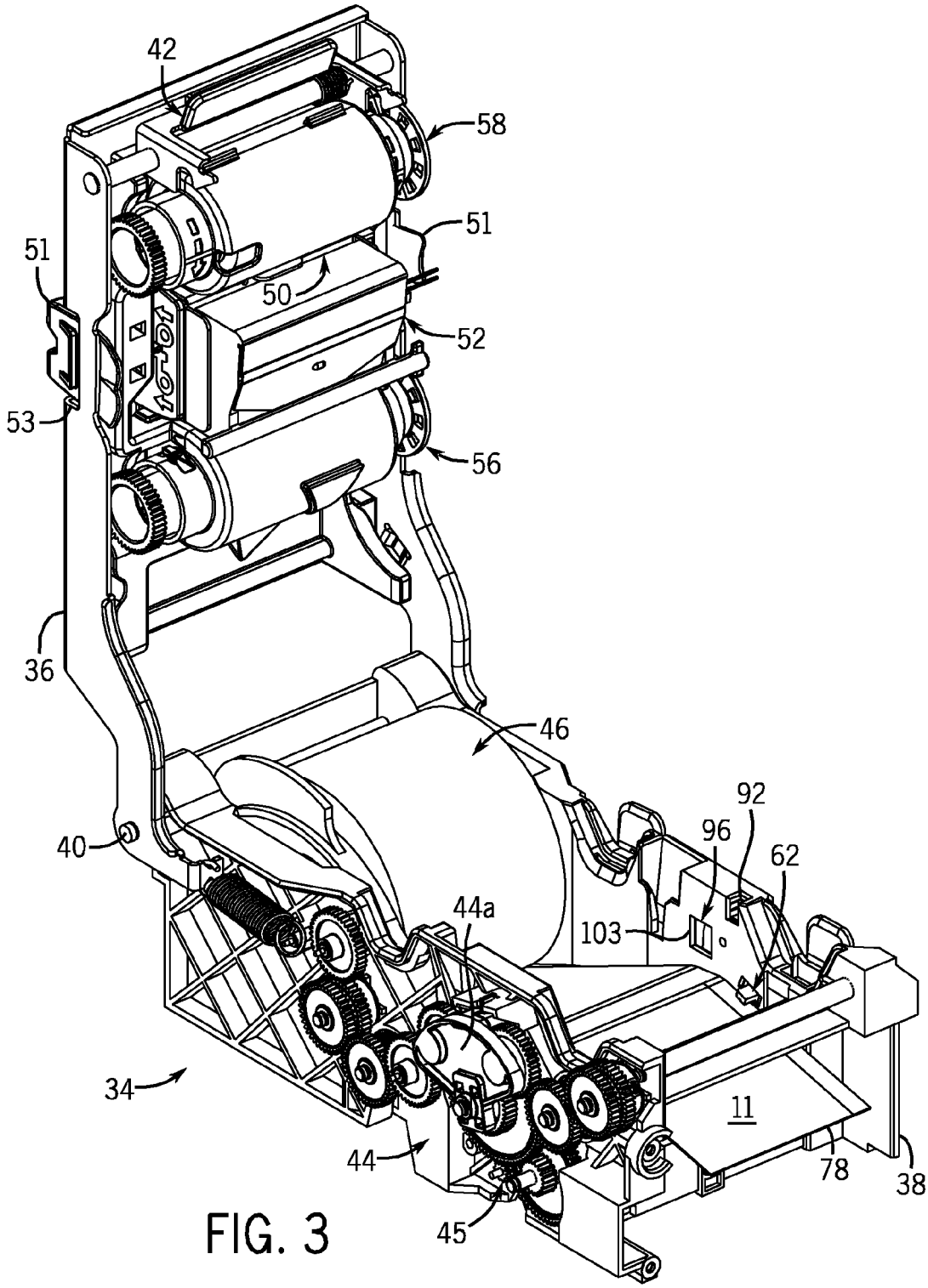
FIG. 3 is an isometric view of the print assembly of FIG. 2 shown with the upper frame in the opened position.
Figure 4:
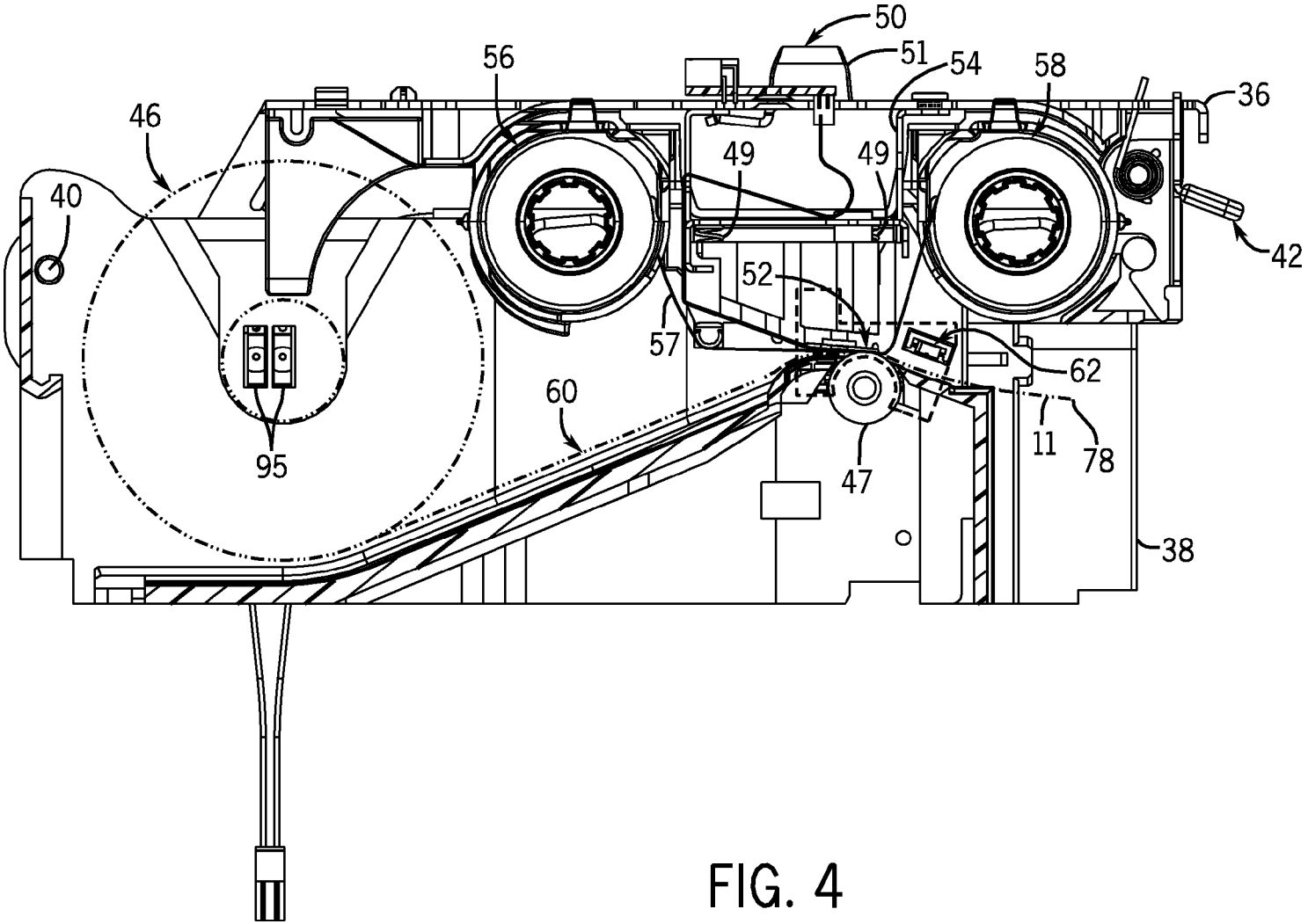
FIG. 4 is a partial section view along line 4-4 of FIG. 2.

With additional reference to FIGS. 3 and 4, the print assembly 34 is shown in FIG. 3 after the latch 42 has been released to allow the upper print frame 36 to pivot away from the lower print frame 38 into the opened position, thus exposing the interior of the print assembly 34. A roll assembly 46 is located within the lower print frame 38 and carries a web of the print media 11. As is appreciated by one skilled in the art, the roll assembly 46 may comprise a variety of print media 11, such as adhesive labels or plain paper.

Attached to the upper print frame 36 are the ribbon cartridge 50 and a print head 52. The print head 52 is moveably coupled to a bracket 54 such that the print head 52 is biased toward the drive roller 47 by a group of springs 49 when the upper print frame 36 is in the closed position (shown best in FIG. 4). The ribbon cartridge 50 is secured to the upper print frame 36 by a pair of clips 51 that extend from the ribbon cartridge 50 and snap-fit into a pair of notches 53 formed in the upper print frame 36.

The ribbon cartridge 50 includes a supply spool 56 and a take-up spool 58 that are rotatably coupled to a ribbon 57. The ribbon 57 (shown only in FIG. 4 for clarity) can be unwound from the supply spool 56 during printing, fed downstream toward the print head 52, and then wound to the take-up spool 58. In certain circumstances, the ribbon 57 can be unwound from the take-up spool 58, back-fed upstream toward the supply spool 56, and rewound to the supply spool 56.

With specific reference to FIG. 4, the engagement between the print head 52 and the drive roller 47 establishes a nip pressure on the print media 11 and the ribbon 57 as each passes between the print head 52 and the drive roller 47. As previously noted, the nip pressure ensures a sufficient amount of friction between the print media 11 and the drive roller 47 to allow the drive roller 47 to translate the print media 11 downstream and upstream of the print head 52 as required.

During printing, the print media 11 moves along a path 60 (best shown in FIG. 4) that extends adjacent the print head 52 and drive roller 47. As the print media 11 passes between the print head 52 and the drive roller 47, the print head 52 is selectively heated to apply heat to the ribbon 57 causing the print material to be transferred from the ribbon 57 to the print media 11. The print head 52 includes the various components of a thermal transfer print head, such as heating elements allowing for the selective heating of the print head 52, associated control circuitry, a heat sink for the dissipation of the heat from the print head 52, and the like, that are known to those skilled in the art.

The structure and operation of the printer 10, including a downstream sensor 62 is described in greater detail with reference first to FIGS. 4 and 5. The downstream sensor 62 is configured such that the downstream sensor 62 provides information to the controller 15 to prevent the drive motor 45 from back-feeding the print media 11 upstream beyond the interface between the print head 52 and the drive roller 47, thereby maintaining the requisite nip pressure.

Figure 7:
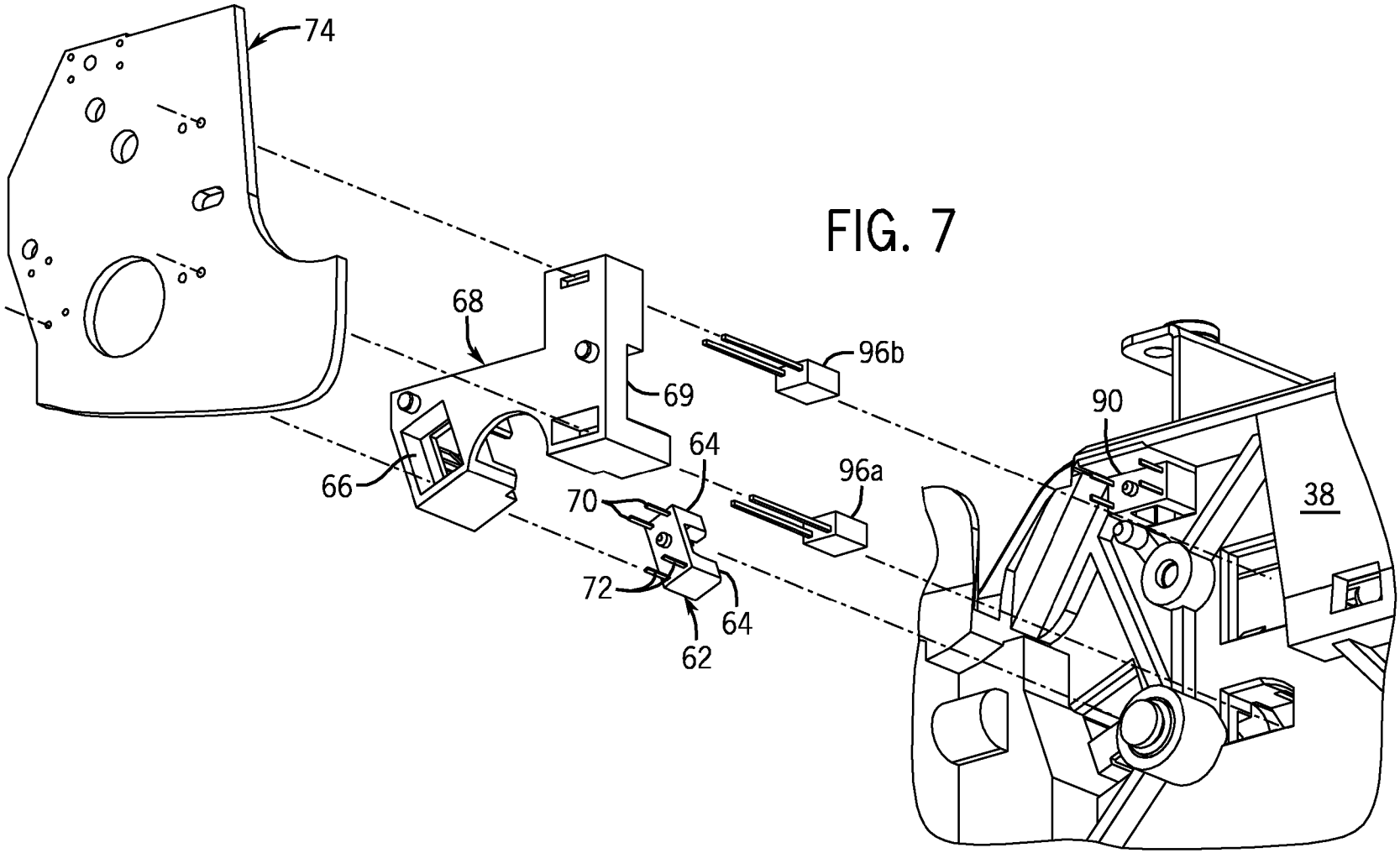
FIG. 7 is a partial detailed exploded view similar to FIG. 6.

The downstream sensor 62 is shown positioned adjacent the path 60 such that the sensor 62 of example embodiment has a generally U-shaped form factor allowing the path 60 of the print media 11 to traverse between a pair of arms 64 (best shown in FIG. 7). The downstream sensor 62 is positioned downstream of the drive roller 47 to sense print media 11 downstream of the print head 52. The downstream sensor 62 is secured in a pocket 66 formed in a sensor standoff 68. A first pair of leads 70 and a second pair of leads 72 extend through a sensor board 74 where they are operationally coupled to the controller 15 by conventional techniques known to those skilled in the art. The downstream sensor 62 of the present invention is preferably a photo-interrupter type, but can be any number of optical sensors (e.g., light emitting diodes, photodiodes, lasers, etc.), ultrasonic sensors, and the like.

The downstream sensor 62 is used by the printer 10 to detect various portions of the print media 11. With specific reference to FIG. 9, the print media 11 may define a leading edge 78 distal from the roll assembly 46 of the example embodiment. Additionally, the print media 11 may include a print area 80 defining the bounds within which the print head 52 should print, a top 82 defining the end of the print area 80 that is first to pass under the print head 52 when the print media 11 is traveling in the downstream direction along the path 60, and a print line location 84 defining the desired location of the image to be printed on the print media 11.

The print media 11 may further include some form of indices 86, 88 that may be sensed by the downstream sensor 62. The indices 86, 88 further allow the downstream sensor 62 to sense the location of the print media 11 relative to the print head 52 thereby defining the spatial relationship. With the spatial relation properly defined, the downstream sensor 62, in communication with the controller 15, can operate the drive motor 45 (e.g., stepper motor) to translate the print media 11 either downstream or upstream relative to the print head 52 to align any portion of the print media 11, such as the print area 80, top 82, or any print line location 84, proximate the print head 52.

Figure 9:
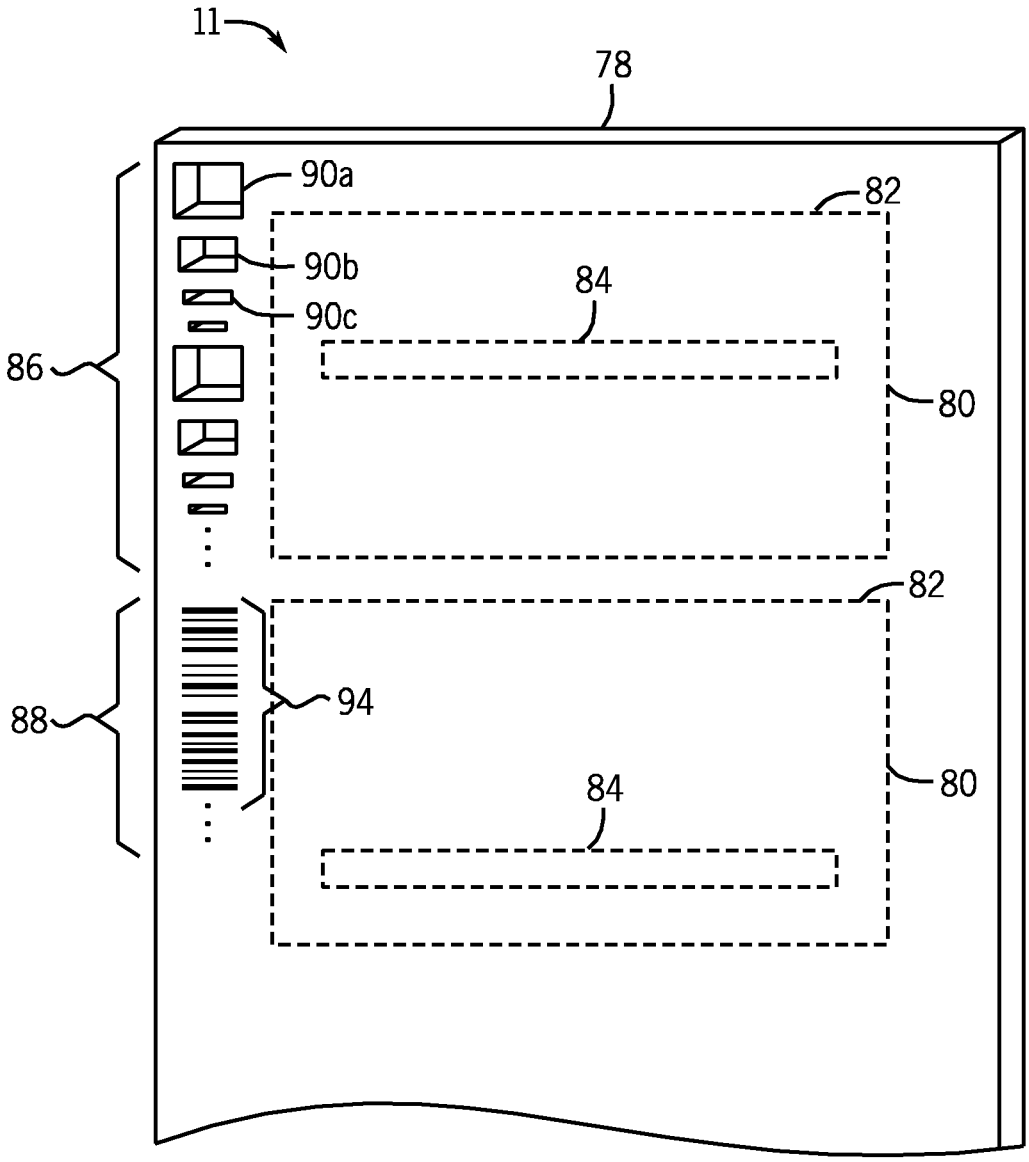
FIG. 9 is a detailed view of an example print media for use with the present invention.

As shown generally in FIG. 9, the print media 11 may include a variety of indices 86, 88. For example, indices 86 may comprise a plurality of openings 90*a*, 90*b*, 90*c*, 90*d* of varying (or similar) sizes that are sensed by the downstream sensor 62 and correlate to a location on the print media 11 preprogrammed into the controller. Alternatively, the indices 88 may be markings 94 on the print media 11 that can be sensed or scanned by the downstream sensor 62, again allowing the controller 15 to determine the positioning of the print media 11 relative to the print head 52.

While the downstream sensor 62 may provide location information of the print media 11 at any time, the downstream sensor 62 is of increased importance when the printer 10 is powered up or when the controller 15 determines that the print media 11 may have been altered or changed. In one situation, the controller 15 may be configured such that after receiving a power on signal (i.e., an indication that the operating power for the printer 10 was cycled or interrupted), the controller 15 first interrogates the downstream sensor 62 to determine if print media 11 is downstream of the print head 52. If no print media 11 is detected at the downstream sensor 62, the controller 15 may drive the drive motor 45 to translate the print media 11 downstream until the downstream sensor 62 senses the leading edge 78 or an indicia 86, 88. The controller 15, given the preprogrammed parameters of the print media 11, may then back-feed the print media 11 the desired amount to align the print head 52 to the desired print line location 84 without back-feeding the print media 11 beyond the interface between the print head 52 and the drive roller 47, thereby ensuring sufficient nip pressure to drive the print media 11.

In addition, or alternatively, the controller 15 may be configured such that after receiving a print media modification signal, the controller 15 first interrogates the downstream sensor 62 to determine if print media 11 is downstream of the print head 52. Again, if no print media 11 is detected at the downstream sensor 62, the controller 15 may drive the drive motor 45 to translate the print media 11 downstream until the downstream sensor 62 senses the leading edge 78 or an indicia 86, 88. The controller 15, given the preprogrammed parameters of the print media 11, may then back-feed the print media 11 the desired amount to align the print head 52 to the desired print line location 84 without back-feeding the print media 11 beyond the interface between the print head 52 and the drive roller 47, thereby ensuring sufficient nip pressure to drive the print media 11.

In any event, if interrogation of the downstream sensor 62 by the controller 15 reveals print media 11 at the downstream sensor 62, the controller 15 may back-feed the print media 11 until the downstream sensor 62 detects either an indicia 86, 88 or the leading edge 78. As before, detection of the indices 86, 88 or leading edge 78 by the downstream sensor 62 allows the controller 15 to define the spatial relation between the print media 11 and the print head 52.

The print media modification signal may be generated by multiple techniques. For example, with reference to FIGS. 6 and 7, an upper print frame sensor 90 is seated in a notch 92 formed in the lower print frame 38. A protrusion (not shown) extending from the upper print frame 36 extends into the notch 92 when the upper print frame 36 is secured in the closed position (shown in FIG. 2), thereby allowing the upper print frame sensor 90 to monitor the relative location of the upper print frame 36. The controller 15 monitors the upper print frame sensor 90 such that a change in the upper print frame sensor 90 results in the controller 15 initiating the steps of detecting the leading edge 78 of the print media 11 with the downstream sensor 62 and then, if the print media 11 is detected, back-feeding the print media 11 upstream with the drive roller 47 to position the print line location 84 proximate the print head 52. Alternatively, communication between the roll assembly 46 and the controller 15 via contacts 95 (shown in FIG. 4) may establish the print media modification signal used by the controller 15 as removal or replacement of the roll assembly 46 may be easily monitored. One skilled in the art will appreciate the variety of alternative techniques available.

Figure 5:
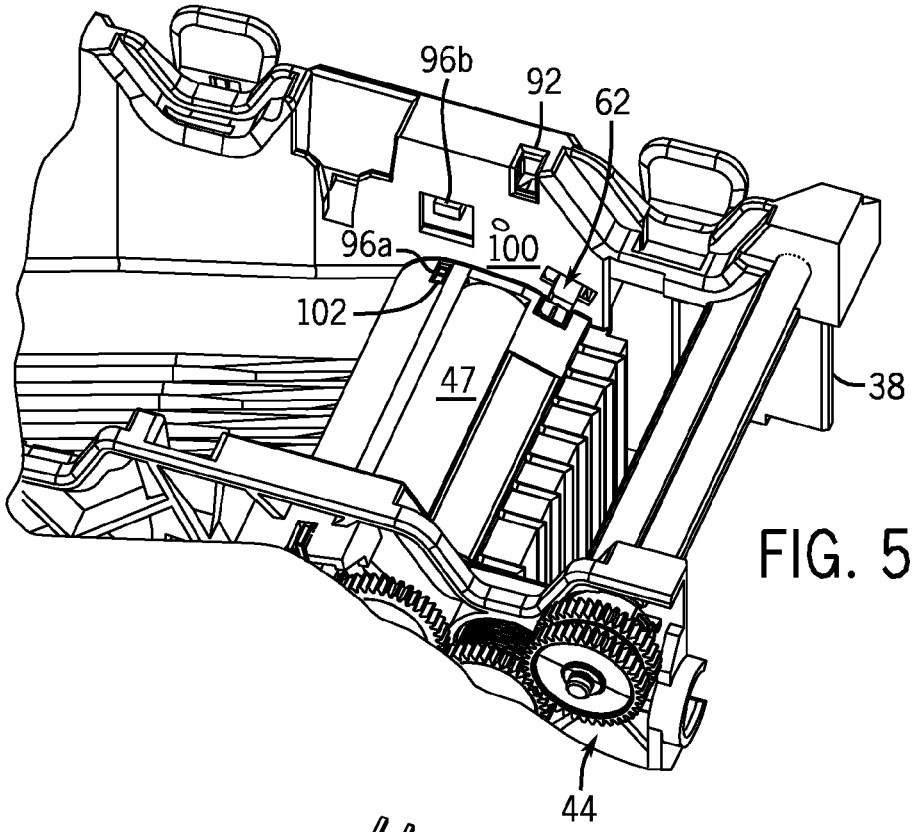
FIG. 5 is a partial detailed isometric view of the print assembly shown in FIG. 2.
Figure 6:
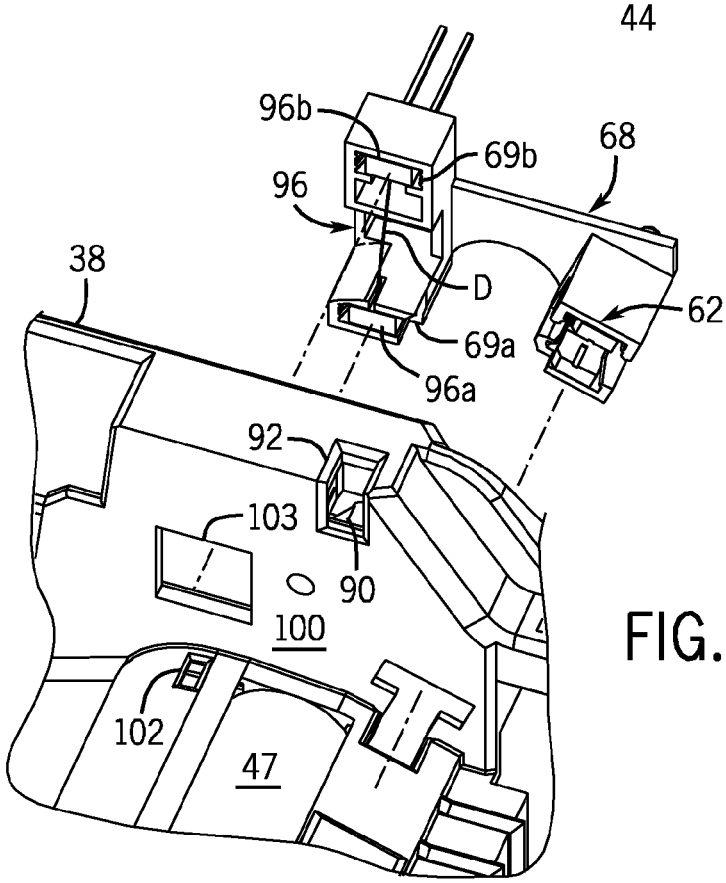
FIG. 6 is a partial detailed exploded view showing the several sensors.

The downstream sensor 62 may be used in combination with an upstream sensor 96 positioned upstream of the print head 52 (best shown in FIGS. 5-7). The upstream sensor 96 includes a first upstream sensor portion 96*a* and a second upstream sensor portion 96*b* that operate cooperatively to detect the print media 11 upstream of the drive roller 47. The upstream sensor 96 is configured such that the positioning of the first upstream sensor portion 96*a* and the second upstream sensor portion 96*b* allows clearance for the ribbon cartridge 50 as the upper print frame 36 is pivoted into the closed position. While the upstream sensor 96 is shown as two components, the first upstream sensor portion 96*a* and the second upstream sensor portion 96*b* may be integral, similar to the combination of the arms 64 of the downstream sensor 62.

With specific reference to FIGS. 6 and 7, the first upstream sensor portion 96*a* and the second upstream sensor portion 96*b* are positioned such that second upstream sensor portion 96*b* is both vertically offset and horizontally offset from the first upstream sensor portion 96*a* with respect to the general path of the print media 11, while still establishing a detection path (shown as wavy line D in FIG. 6) capable of detecting the print media 11. Thus, the detection path D defined between the first upstream sensor portion 96*a* and the second upstream sensor portion 96*b* is substantially non-normal to the path 60. One skilled in the art will appreciate the geometric variations of the upstream sensor 96 that provide a similar two-direction offset, whether the two directions are orthogonal or define any other relation (e.g., obtuse).

In the preferred example embodiment shown, the two-direction offset of the upstream sensor 96 is provided by the sensor standoff 68. The sensor standoff 68 includes an L-shaped segment 69 that receives the first upstream sensor portion 96*a* in a lower pocket 69*a* and the second upstream sensor portion 96*b* in an upper pocket 69*b* that is offset upward and outward with respect to the orientation shown in FIGS. 5 and 6. When the upstream sensor 96 is coupled to the lower print frame 38 (shown in FIG. 5) the first upstream sensor portion 96*a* is positioned proximate an opening 102 beneath and adjacent the print media path 60 and upstream of the drive roller 47. Given the two-direction offset of the upstream sensor 96, the second upstream sensor portion 96*b* is positioned proximate an opening 103 formed in a side wall 100 adjacent the path 60 of the print media 11.

Similar to the downstream sensor 62, the upstream sensor 96 may be configured to detect the presence of the print media 11 and/or any variation of indices 86, 88 thereon allowing the controller 15 to correlate the indices 86, 88 to relative position between the print media 11 and the print head 52. Notably, the upstream sensor 96 will not prevent back-feeding of the print media 11 in the same manner as the downstream sensor 62 (i.e., by detecting the leading edge 78 of the print media 11).

Figure 8:
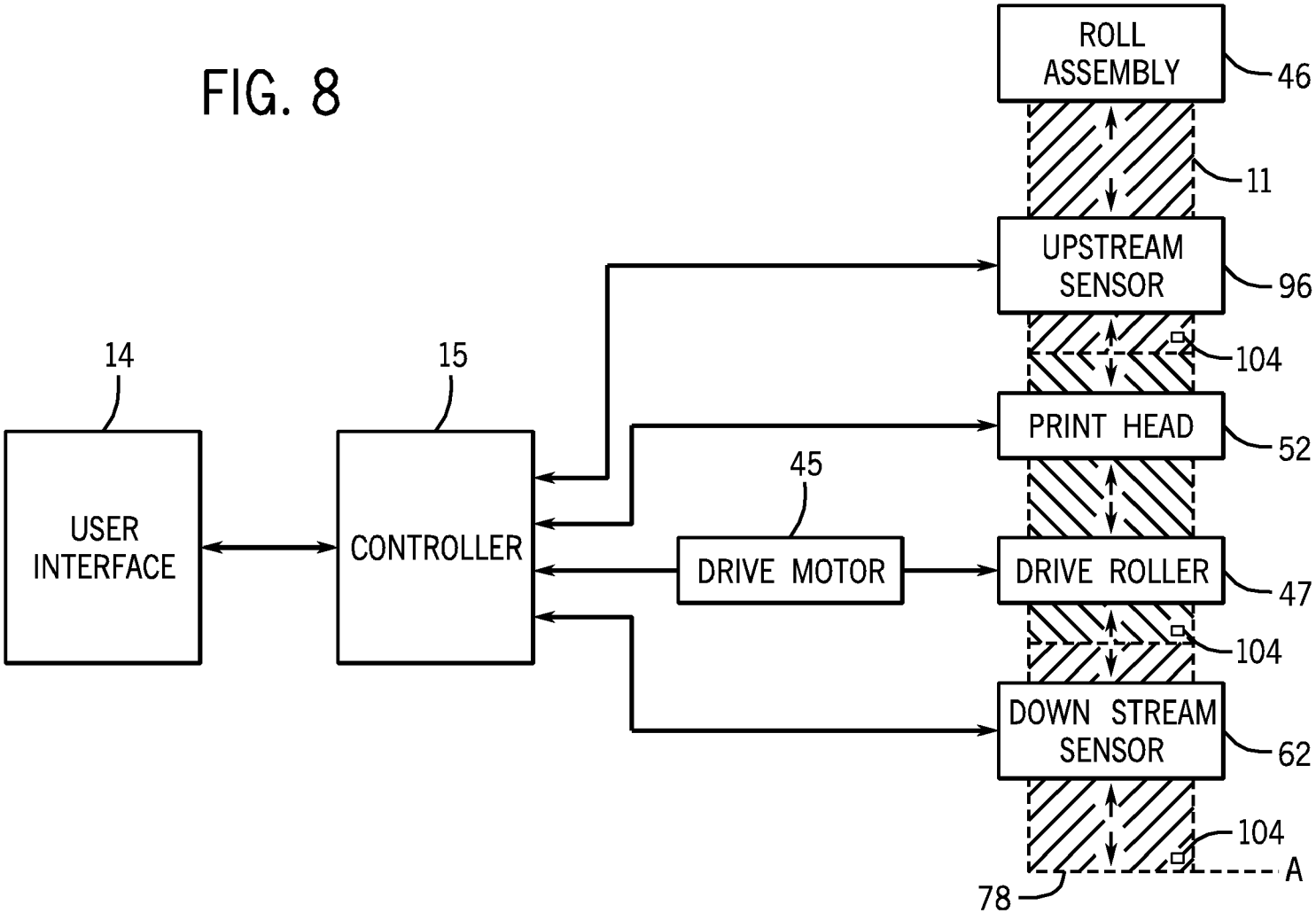
FIG. 8 is a schematic showing selected components of the printer.

Turning to FIG. 8, the operation of the printer 10 and interaction of the various components are shown in a simplified schematic. In the example embodiment, described in relation to a thermal transfer printer 10 for printing labels, a user may enter label information to the printer 10 via the user interface 14. Additionally, the printer 10 may be programmed with the printing parameters for the particular print media 11 loaded in the printer 10. The controller 15 receives the user input via the user interface 14 and formats the print data in accordance with the printing parameters and the requirements of the printing process (e.g., establishing the instructions required to drive the drive motor 45 and activate the print head 52).

In the situation where the controller 15 has not defined the relative position of the print media 11 with respect to the print head 52, such as when the printer 10 is power cycled (i.e., the controller 15 receives the power on signal), when the print media 11 is modified (i.e., when the controller 15 receives the print media modification signal), or in any other circumstance in which the controller 15 lacks the requisite print media 11 location information, the controller 15 may use the downstream sensor 62 to detect and register with the controller 15 the first label produced from the print media 11.

For example, assuming the leading edge 78 of the print media 11 is located initially at location A (shown in FIG. 8), the controller 15 having confirmed the presence of the print media 11 at the downstream sensor 62 will drive the drive motor 45, and hence drive roller 47 in the upstream direction to translate the print media 11 along the path 60 until the downstream sensor 62 detects either the leading edge 78 or an indicia 104 (similar to indices 86, 88), thereby registering the first label with the controller 15 and allowing the controller 15 to accurately position the print media 11 proximate the print head 52. The controller 15 then drives the print media 11 downstream during which the upstream sensor 96 is used to detect the indicia 104 (or any similar identifying marking or configuration) of subsequent labels from the roll assembly 46 to register the subsequent labels with the controller 15 during printing. As a result, the downstream sensor 62 preferably registers the first label with the controller 15 and the upstream sensor 96 preferably registers each subsequent label with the controller 15 until the controller 15 determines that the spatial relation between the print media 11 and the print head 52 is undefined.

While there has been shown and described what is at present considered the preferred embodiment of the invention, it will be obvious to those skilled in the art that various changes and modifications can be made therein without departing from the scope of the invention defined by the following claims. For example, the type of sensors used in accordance with the present invention can be of any type as will be appreciated by those skilled in the art. These variations, among others, are contemplated by and within the scope of the present invention.

We claim:

1. A method of print media back-feed control for a printer, comprising the steps of:

providing a print media having a leading edge and defining a print line location;

providing a printer having:

a print head for printing to the print media;

a drive roller for driving the print media upstream and downstream relative to the print head; and a downstream sensor positioned downstream of the drive roller;

detecting the leading edge of the print media with the downstream sensor; and back-feeding the print media upstream with the drive roller to position the print line proximate the print head.

2. The method of claim 1, wherein:

the printer is a thermal transfer printer;

the drive roller is a platen roller; and the sensor is an optical sensor.

3. The method of claim 1, wherein the print media includes indices correlating to at least one of the print line location and a top of the print media.

4. The method of claim 3, further comprising the step of detecting the indices with the downstream sensor.

5. The method of claim 1, wherein the step of detecting the leading edge of the print media with the downstream sensor further comprises registering a downstream location of the print media to a controller in communication with the print head, drive roller, and downstream sensor.

6. The method of claim 5, further comprising the steps of:

providing an upstream sensor positioned upstream of the drive roller and in communication with the controller;

detecting the print line location with the upstream sensor; and registering an upstream location of the print media to the controller.

7. The method of claim 1, further comprising the steps of:

providing a controller in communication with at least one of the print head, the drive roll, and the downstream sensor, and configured to receive at least one of a power on signal and a print media modification signal; and initiating the steps of detecting the leading edge of the print media with the downstream sensor and then back-feeding the print media upstream with the drive roller to position the print line proximate the print head in response to at least one of the power on signal and the print media modification signal.

8. The method of claim 1, further comprising the step of providing an upstream sensor positioned upstream of the drive roller, wherein the upstream sensor includes a first upstream sensor portion and a second upstream sensor portion offset from the first upstream sensor portion in a first direction and a second direction.

9. A method of print media back-feed control for a printer, comprising the steps of:

providing a print media having a leading edge and including indices correlated to a print line location;

providing a printer having:

a print head for printing to the print media;

a drive roller for driving the print media upstream and downstream relative to the print head;

a downstream sensor positioned downstream of the drive roller; and a controller in communication with at least one of the print head, the drive roller, and the downstream sensor;

detecting at least one of the leading edge and the indices of the print media with the downstream sensor; and back-feeding the print media upstream with the drive roller to position the print line proximate the print head.

10. The method of claim 9, wherein:

the printer is a thermal transfer printer;

the drive roller is a platen roller; and the sensor is an optical sensor.

11. The method of claim 9, wherein the step of detecting at least one of the leading edge and the indices of the print media with the downstream sensor further comprises registering a downstream location of the print media to the controller.

12. The method of claim 11, further comprising the steps of:

providing an upstream sensor positioned upstream of the drive roller and in communication with the controller;

detecting the print line location with the upstream sensor; and registering an upstream location of the print media to the controller.

13. The method of claim 9, further comprising the steps of:

sending at least one of a power on signal and a print media modification signal to the controller; and initiating the steps of detecting at least one of the leading edge and the indices of the print media with the downstream sensor and then back-feeding the print media upstream with the drive roller to position the print line proximate the print head in response to at least one of the power on signal and the print media modification signal.

14. The method of claim 9, further comprising the step of providing an upstream sensor positioned upstream of the drive roller and in communication with the controller, wherein the upstream sensor includes a first upstream sensor portion and a second upstream sensor portion offset from the first upstream sensor portion in a first direction and a second direction.

15. A system for print media back-feed control, comprising:

a print media having a leading edge and indices correlated to a print line location;

a printer comprising:

a path for receiving and directing the print media through the printer;

a print head positioned adjacent the path for printing to the print media;

a drive roller positioned adjacent the path for driving the print media upstream and downstream relative to the print head; and a downstream sensor positioned adjacent the path and downstream of the drive roller;

wherein the downstream sensor detects at least one of the leading edge and the indices of the print media as the print media travels along the path; and wherein the drive roller selectively back-feeds the print media upstream along the path to position the print line proximate the print head.

16. The system of claim 15, wherein:

the printer is a thermal transfer printer;

the drive roller is a platen roller; and the sensor is an optical sensor.

17. The system of claim 15, further comprising an upstream sensor positioned proximate the path and upstream of the drive roller, wherein the upstream sensor includes a first upstream sensor portion positioned adjacent the path and a second upstream sensor portion offset from the first upstream sensor portion in a first direction and a second direction.

18. A printer for driving a print media along a path for receiving and directing the print media through the printer, comprising:

a print head positioned adjacent the path for printing to the print media;

a drive roller positioned adjacent the path for driving the print media upstream and downstream relative to the print head; and an upstream sensor positioned proximate the path and upstream of the drive roller; wherein the upstream sensor includes a first upstream sensor portion positioned adjacent the path and a second upstream sensor portion offset from the first upstream sensor portion in a first direction and a second direction substantially relative to the path.

19. The printer of claim 18, wherein the first direction is orthogonal to the second direction.

20. The printer of claim 18, further comprising a downstream sensor positioned adjacent the path and downstream of the drive roller.

* * * * *